US012232553B2

(12) United States Patent
Qiu

(10) Patent No.: US 12,232,553 B2
(45) Date of Patent: Feb. 25, 2025

(54) MOUNTING STRUCTURE OF HELMET

(71) Applicant: Ningbo JieMai Safety and Protective Equipment Co., Ltd., Ningbo (CN)

(72) Inventor: Kang Qiu, Ningbo (CN)

(73) Assignee: NINGBO JIEMAI SAFETY AND PROTECTIVE EQUIPMENT CO., LTD., Ningbo (CN)

( * ) Notice: Subject to any disclaimer, the term of this patent is extended or adjusted under 35 U.S.C. 154(b) by 162 days.

(21) Appl. No.: 18/323,151

(22) Filed: May 24, 2023

(65) Prior Publication Data

US 2024/0349836 A1 Oct. 24, 2024

(30) Foreign Application Priority Data

Apr. 21, 2023 (CN) ..... 202320912975.6

(51) Int. Cl.
*A42B 3/04* (2006.01)
*A42B 3/28* (2006.01)

(52) U.S. Cl.
CPC ..... *A42B 3/0406* (2013.01); *A42B 3/283* (2013.01)

(58) Field of Classification Search
CPC ..... A42B 3/0406; A42B 3/283; A42B 3/04; A42B 3/228; A42B 3/225; A61F 9/06; F16M 13/04
See application file for complete search history.

(56) References Cited

U.S. PATENT DOCUMENTS 5,638,544 A * 6/1997 Sump ..... A42B 3/003 2/6.6
7,219,370 B1 * 5/2007 Teetzel ..... F41G 1/30 2/6.2
8,555,423 B2 * 10/2013 Giroux ..... A42B 3/185 2/422
8,677,516 B2 * 3/2014 Prendergast ..... A42B 3/04 248/674
9,414,633 B2 * 8/2016 Giroux Bernier ..... A42B 3/221
(Continued)

FOREIGN PATENT DOCUMENTS

CA 2862663 A1 * 7/2013 ..... A42B 3/08
WO WO-2010129397 A1 * 11/2010 ..... A42B 3/04
(Continued)

*Primary Examiner* — Tajash D Patel
(74) *Attorney, Agent, or Firm* — MUNCY, GEISSLER, OLDS & LOWE, P.C.

(57) ABSTRACT

A mounting structure of a helmet is disclosed. The helmet includes a helmet body. The helmet body is provided with a mounting platform. The mounting platform includes a mounting bracket and an adapter. The mounting bracket is formed with two lateral buckles for being respectively clamped into the vent holes at the sides of the helmet and a forward buckle for being inserted into the jack at the front side of the helmet. The mounting bracket is mounted on the helmet body by clamping the two lateral buckles into the respective vent holes and inserting the forward buckle into the jack. The adapter is detachably mounted on the mounting bracket. The adapter is formed with a T-shaped buckle for inserting the terminal device. The mounting structure can mount a variety of terminal devices with the mounting platform, realize a variety of functions, is quick to be assembled and disassembled.

10 Claims, 3 Drawing Sheets

(56) References Cited

U.S. PATENT DOCUMENTS

| | | | | |
|---|---|---|---|---|
| 9,775,397 | B2 * | 10/2017 | Daniels | A42B 3/225 |
| 11,350,689 | B2 * | 6/2022 | Frieder, III | G02C 3/02 |
| 2002/0120979 | A1 * | 9/2002 | Prendergast | G02B 23/125 2/6.6 |
| 2012/0057331 | A1 * | 3/2012 | Janice | F21L 4/02 362/374 |
| 2015/0264229 | A1 * | 9/2015 | Teetzel | H04N 23/56 348/376 |
| 2017/0322481 | A1 * | 11/2017 | Koch | F16M 13/04 |
| 2018/0042774 | A1 * | 2/2018 | Wu | A61F 9/06 |
| 2018/0192727 | A1 * | 7/2018 | Chen | A45F 5/02 |
| 2018/0314052 | A1 * | 11/2018 | Prendergast | G02B 23/16 |
| 2020/0329806 | A1 * | 10/2020 | Wong | H01M 50/10 |
| 2023/0329386 | A1 * | 10/2023 | Wong | A42B 3/0406 |
| 2023/0363482 | A1 * | 11/2023 | Sharrah | A42B 3/044 |
| 2024/0118595 | A1 * | 4/2024 | Sheinbaum | F16M 13/04 |

FOREIGN PATENT DOCUMENTS

| | | | | |
|---|---|---|---|---|
| WO | WO-2019155269 | A1 * | 8/2019 | |
| WO | WO-2020183132 | A2 * | 9/2020 | A42B 3/042 |
| WO | WO-2023012826 | A1 * | 2/2023 | |

* cited by examiner

MOUNTING STRUCTURE OF HELMET

CROSS REFERENCE TO RELATED APPLICATIONS

This application is based upon and claims priority to Chinese Patent Application No. CN 202320912975.6, filed on Apr. 21, 2023, the entire contents of which are incorporated herein by reference.

TECHNICAL FIELD

The disclosure belongs to the technical field of helmets, in particular to a mounting structure of a helmet.

BACKGROUND ART

Traditional helmets are not equipped with terminal devices such as headlights or cameras. Those who need these terminal devices have to buy a helmet with special functions, such as lighting a helmet and a capturing helmet. For such a helmet, a lighting lamp, a camera or the like are directly inserted into jacks on a front side of the helmet. The helmet with special functions which is mounted and fixed with a terminal device can only have one function. When multiple functions are needed, it is necessary to reserve multiple helmets, which is inconvenient to use and increases cost. This type of helmet is with a fixed mounting position of the terminal device which cannot be adjusted, which may affect folding of a goggle, that is to say, the goggle may be blocked by the terminal device and cannot be completely folded in place when it is turned over.

SUMMARY

A mounting structure of a helmet is provided in this disclosure so as to solve technical problems described above, which specifically adopt following technical schemes.

A mounting structure of a helmet includes a mounting platform for mounting at least one terminal device. The mounting platform is arranged on a helmet body. A jack for inserting an external part is formed at a front side of the helmet body. Vent holes for heat dissipation and ventilating in the helmet body are respectively formed at both sides of the helmet body. The mounting platform includes a mounting bracket and an adapter. The mounting bracket is formed with at least two lateral buckles for being respectively clamped into the vent holes at the sides of the helmet body and a forward buckle for being inserted into the jack at the front side of the helmet body. The mounting bracket is mounted on the helmet body by clamping the two lateral buckles into the respective vent holes and inserting the forward buckle into the jack. The adapter is detachably mounted on the mounting bracket. The adapter is formed with a T-shaped buckle for inserting at least one terminal device.

Further, a support plane for supporting the mounted terminal device is respectively formed at an upper end and a lower end of the T-shaped buckle.

Further, the mounting bracket is formed with a mounting surface. A mounting shaft is respectively formed at both sides of the mounting surface. Shaft sleeves for matching with two mounting shafts are respectively formed at two sides of the adapter. The adapter is detachably mounted on the mounting bracket by inserting the mounting shafts into the shaft sleeves.

Further, the mounting shaft is formed with a guide ramp for guiding a respective sleeve to be sleeved on a periphery of the mounting shaft.

Further, the mounting bracket is provided with a steering gear for adjusting an angle of the adapter on the mounting surface. The steering gear is rotatably provided with toggle teeth. The adapter is formed with a rotating latch for meshing with the toggle teeth. The rotating latch is configured to cause the toggle teeth to rotate by pressing the toggle teeth.

Further, the shaft sleeve is formed with a rotating latch.

Further, the adapter is further formed with two elastic support sheets for elastically supporting and pressing the terminal device. The elastic support sheets are formed with a support protrusion for protruding and supporting the terminal device so as to form a heat dissipation gap between the terminal device and the adapter.

Further, the mounting surface is formed with two ribs for abutting against the elastic support sheets to force the elastic support sheets to press the mounted terminal device. The two ribs are arranged in one-to-one correspondence with the two elastic support sheets.

Further, an adjusting fan for adjusting sizes of the vent holes is respectively slidably connected at two sides in the helmet body. An adjusting hole is respectively provided at the both sides of the helmet body. The adjusting fan is formed with an adjusting protrusion. The adjusting protrusion is configured to pass through the adjusting hole and slide up and down along the adjusting hole.

Further, an arched guide surface for matching with an upper side of the adjusting fan to guide the adjusting fan to slide up and down so as to close or open the vent holes is formed at a lower end of a part where the lateral buckles are clamped into the vent holes.

The disclosure has advantages that the mounting platform is additionally mounted in the mounting structure of the provided helmet by combining existing vent holes of a traditional helmet and a jack structure, and the mounting platform can be adapted to different terminal devices through the adapter to realize multiple functions so as to meet customer requirements in different application scenarios, and thus universality is high and use cost can be saved, and with a mounting structure of the buckle and the holes, mounting is fast and quick and use is more convenient. Both the mounting platform and the adapter adopt a detachable structure, which is with high mounting flexibility and can be determined to be mounted or not according to customer's needs, without purchasing a special helmet with this function. In other words, the mounting platform can be matched for mounting of the terminal device such as headlights, cameras (gopro, etc.), GPS positioning devices and spare batteries by mounting different types of adapters, which is highly extensible.

BRIEF DESCRIPTION OF THE DRAWINGS

In order to explain the embodiments of the present disclosure or the technical scheme in the prior art more clearly, the drawings required in the description of the embodiments or the prior art will be briefly introduced below; obviously, the drawings in the following description are only some embodiments of the present disclosure, and other drawings can be obtained according to these drawings by those of ordinary skill in the art without paying creative labor.

Figure 1:
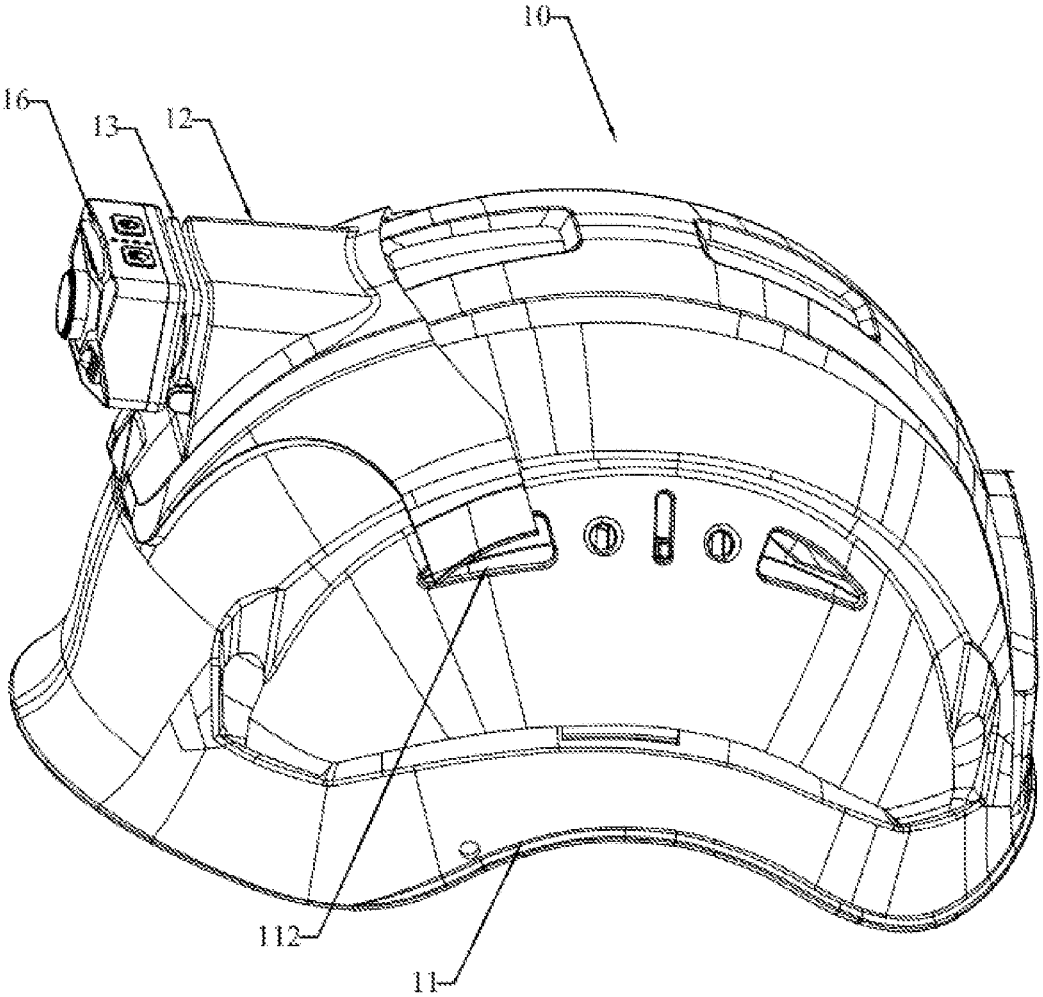
FIG. 1 is a schematic view of a mounting structure of a helmet according to this disclosure.
Figure 2:
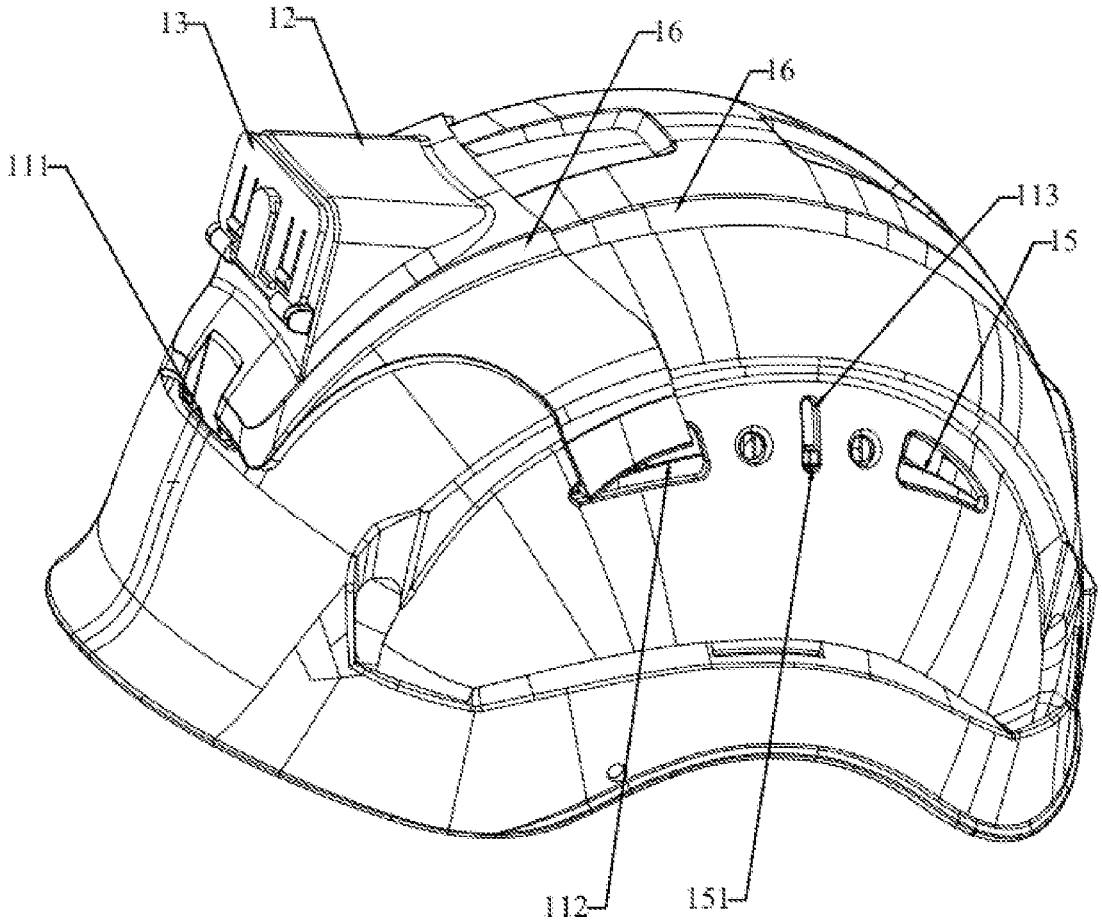
FIG. 2 is a schematic view of the mounting structure of the helmet in FIG. 1 with a terminal device disassembled.

Mounting structure 10 of Helmet, Helmet body 11, Jack 111, Vent hole 112, Regulating hole 113, Mounting bracket 12, Lateral buckle 121, Arched guide surface 122, Forward buckle 123, Mounting surface 124, Mounting shaft 125, Guide ramp 126, Rib 127, Adapter 13, T-shaped buckle 131, Support plane 132, Shaft sleeve 133, Rotating latch 134, Elastic supporting sheet 135, Support protrusion 136, Toggle teeth 14, Adjusting fan 15, Adjusting protrusion 151, Guide step 16.

DETAILED DESCRIPTION

Embodiments of the present disclosure will be described in detail below, examples of which are shown in the accompanying drawings, in which same or similar reference numerals refer to same or similar elements or elements with same or similar functions throughout. The embodiments described below with reference to the drawings are exemplary and are intended to explain the present disclosure, but should not be construed as limiting the present disclosure.

In description of this disclosure, unless otherwise specified and limited, the terms "coupling", "connecting" and "fixing" should be understood in a broad sense, for example, it can be "fixedly connecting", or "detachably connecting" or "integrally connecting", or it can be "mechanically connecting" or "electrically connecting", or it can be "directly connecting" or "indirectly connecting through an intermediate medium", or it can be "communicating within two elements" or an interaction between two elements. For a person of ordinary skill in the art, specific meanings of the above terms in the present disclosure can be understood according to specific situations.

In this disclosure, unless otherwise specified and limited, a first feature being located "above" or "below" a second feature may involve direct contact between the first and second features, or may involve that the first and second features are not in direct contact with each other but in contact through another feature between them. Moreover, the first feature being located "over", "above" or "on" the second feature may involve that the first feature is directly above and obliquely above the second feature, or only indicate that a level of the first feature is higher than that of the second feature. The first feature being located "under", "below" or "beneath" the second feature may involve that the first feature is directly below and obliquely below the second feature, or only indicate that a level of the first feature is lower than that of the second feature.

As shown in FIGS. 1 to 4, a mounting structure 10 of a helmet of the present disclosure includes a helmet body 11. A jack 111 is formed at a front side of the helmet body 11, and external parts such as headlights can be directly inserted into the jack 111. The jack 111 herein is an original mounting structure of the helmet body 11, which is a part of the mounting structure in this scheme, thus saving cost of redesigning and processing the mounting hole. Vent holes 112 are respectively formed at both sides of the helmet body 11 for radiating and ventilating the helmet body 11.

Figure 3:
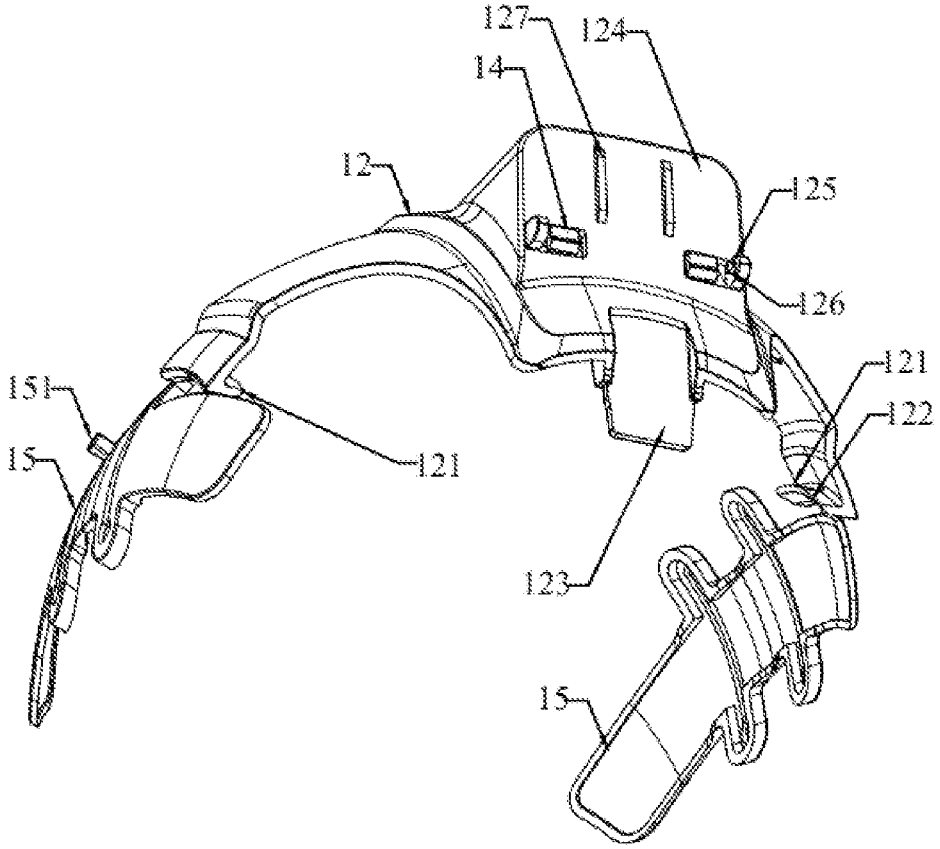
FIG. 3 is a schematic diagram of matching of a mounting platform and an adjusting fan of the mounting structure of the helmet in FIG. 1.
Figure 4:
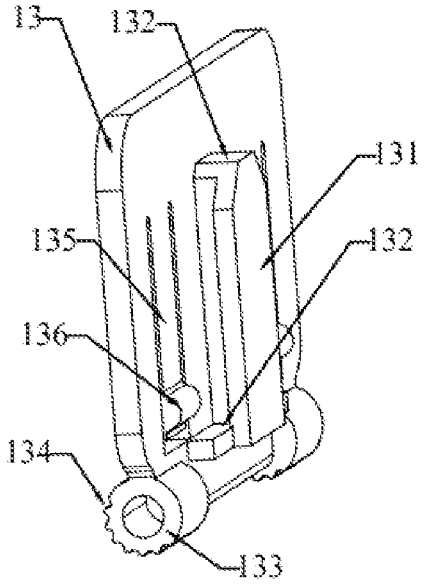
FIG. 4 is a schematic view of an adapter of the mounting structure of the helmet in FIG. 1.

Further, the helmet body 11 is provided with an mounting platform, through which various terminal devices 16 can be mounted, such as headlights, cameras (gopro, etc.), GPS positioning devices, spare batteries, etc., to realize various functions. Specifically, the mounting platform includes a mounting bracket 12 and an adapter 13. The mounting bracket 12 is formed with at least two lateral buckles 121, the at least two lateral buckles 121 are respectively configured for clamping into the vent holes 112 at sides of the helmet body 11, and the mounting bracket 12 is further formed with a forward buckle 123, the forward buckle 123 is configured for inserting into the jack 111 at the front side of the helmet body 11. In this way, the mounting bracket 12 is mounted on the helmet body 11 by clamping the two lateral buckles 121 into the respective vent holes 112 and inserting the forward buckle 123 into the jack 111. Such a connection structure is detachable, and it is convenient to disassemble and replace the mounting platform as a whole, and it can be selected to perform mounting or not according to actual needs. The jack 111 and the vent hole 112 are the original holes on the helmet body 11, and the original holes are used for mounting, so it is not necessary to redesign a structure of the helmet body 11 and reduce production cost. The forward buckle 123 in this scheme is as shown in FIG. 3, which is an insertion piece and can be made of flexible material so as to facilitate elastic clamping. The adapter 13 is detachably mounted on the mounting bracket 12, and the adapter 13 is formed with a T-shaped buckle 131 for inserting the terminal device 16. That is to say, the terminal device 16 is formed with a slot matched with the T-shaped buckle 131. In mounting, the terminal device 16 can be inserted directly, which is convenient for replacement. In addition, different types of adapters 13 can be designed according to different terminal devices 16, which can improve an adaptation range of the adapters, thus improving versatility.

Therefore, the mounting platform is additionally mounted in the mounting structure 10 of the provided helmet by combining an existing vent hole structure 112 of a traditional helmet, and the mounting platform can be adapted to different terminal devices 16 through the adapter 13 to realize multiple functions so as to meet customer requirements in different application scenarios, and thus universality is high and use cost can be saved, and with a mounting structure of the buckle and the holes, mounting is fast and quick and use is more convenient. Both the mounting platform and the adapter 13 adopt a detachable structure, which is with high mounting flexibility and can be determined to be mounted or not according to customer's needs, without purchasing a special helmet with this function. In other words, the mounting platform can be matched for mounting of the terminal device 16 such as headlights, cameras (gopro, etc.), GPS positioning devices and spare batteries by mounting different types of adapters 13, which is highly extensible.

According to the scheme described above, a mounting position of the terminal device 16 can be moved upward by the mounting platform, and a position of the terminal device 16 is adjusted by rotating the adapter 13, so that enough space is provided for the goggle to be folded while the terminal device 16 is ensured to be used conveniently, and thus the goggle can be folded in place and is convenient to use.

As a specific embodiment, a support plane 132 is respectively formed at an upper end and a lower end of the T-shaped buckle 131, through which the mounted terminal device can be supported, thereby improving mounting stability of the terminal device 16.

As a specific embodiment, the mounting bracket 12 is formed with a mounting surface 124, and a mounting shaft 125 is respectively formed at both sides of the mounting surface 124. Shaft sleeves 133 are respectively formed at two sides of the adapter 13 for matching with two mounting shafts 125. In mounting, the adapter 13 is detachably mounted on the mounting bracket 12 by inserting the mounting shafts 125 into the shaft sleeves 133. This mounting structure is simple and easy to be disassembled. The mounting shaft 125 is formed with a guide ramp 126, through which the shaft sleeve 133 can be guided to fit around a periphery of the mounting shaft 125, thereby further improving convenience of mounting.

As a specific embodiment, the mounting bracket 12 is provided with a steering gear on the mounting surface 124, and an angle of the adapter 13 can be adjusted through the steering gear, so that a mounting angle of the terminal device 16 can be adjusted, and use convenience can be improved. Specifically, the steering gear is rotatably provided with toggle teeth 14, and the adapter 13 is formed with a rotating latch 134 for meshing with the toggle teeth 14, and the rotating latch 134 is configured to cause the toggle teeth 14 to rotate by pressing the toggle teeth 14. The steering gear in this scheme is of an adjusting tooth structure, that is, the toggle teeth 14 are formed with an adjusting shaft hole, and limiting teeth are formed in the shaft hole, and a limiting shaft is fixed to the mounting bracket 12, and the limiting shaft is inserted into the adjusting shaft hole and formed with matching teeth for matching with the limiting teeth. There is flexible matching between the limit teeth and the matching teeth. In this way, when the adapter 13 is pressed by applying a preset pressing force to toggle the toggle teeth 14 described above, the toggle teeth 14 can rotate around the limiting shaft, and when the pressing force is removed, a rotational position is limited by the limiting teeth and the matching teeth, so that the adapter 13 is kept at this rotational position. As long as a sufficient toggle force is applied, the adapter 13 can be rotated up and down.

As a specific embodiment, the rotating latch 134 can be formed on the shaft sleeve 133, which simplifies a transmission structure and saves production cost.

As a specific embodiment, the adapter 13 is further formed with two elastic support sheets 135, for elastically supporting and pressing the terminal device 16, and the elastic support sheets are 135 formed with a support protrusion 136, and the support protrusion 136 is configured for protruding and supporting the terminal device 16 so as to form a heat dissipation gap between the terminal device 16 and the adapter 13. Two ribs 127 are formed on the mounting surface 124, and the two ribs 127 are arranged in one-to-one correspondence with the two elastic support sheets. The elastic support sheets 135 can be abutted against by the rib 127 so as to force the elastic support sheets 135 to press the mounted terminal device, thus ensuring mounting stability of the terminal device 16.

As a specific embodiment, an adjusting fan 15 is respectively slidably connected at two sides in the helmet body 11, and the adjusting fan is configured for adjusting sizes of the vent holes 112. An adjusting hole 113 is respectively provided at the both sides of the helmet body 11, while the adjusting fan 15 is formed with an adjusting protrusion 151. In mounting, the adjusting protrusion 151 is configured to pass through the adjusting hole 113 and slide up and down along the adjusting hole 113, so that sizes of the vent holes 112 can be adjusted by toggling the adjusting protrusion 151 up and down, which is convenient to use.

Further, an arched guide surface 122 is formed at a lower end of a part where the lateral buckles 121 are clamped into the vent holes 112, and the arched guide surface 122 is configured for matching with an upper side of the adjusting fan 15 to guide the adjusting fan 15 to slide up and down so as to close or open the vent holes 112, and the adjusting fan 15 is not caught by the lateral buckles 121 when moving up and down. As shown in FIG. 3, when the adjusting fan is adjusted upwards, the arched guide surface 122 presses an upper end of the guiding adjusting fan to move towards an inner side of the helmet body with its arched surface, so that the upper end of the adjusting fan does not collide with lower ends of the lateral buckles 121. With the above scheme, the jack 111 at the front end of the helmet body 11 and the vent holes 112 at the left and right sides are used as fixing points to mount the platform without affecting adjustment of the vent holes 112 by the adjusting fan 15.

The helmet body 11 and the mounting bracket 12 are formed with guide steps 16 matched with each other to guide the mounting bracket 12 for accurate mounting, that is, with matching of the guide steps 16, the lateral buckles 121 can be accurately inserted into respective vent holes 112, and the mounting is fast.

The basic principles, main features and advantages of the present disclosure are shown and described in the above. It should be understood by those skilled in the industry that the above embodiments do not limit the present disclosure in any form, and all technical solutions obtained by equivalent substitution or equivalent transformation fall within the protection scope of the present disclosure.

The invention claimed is:

1. An mounting structure of a helmet, wherein the mounting structure is configured to be matched with the helmet, and the helmet comprises a helmet body, and a jack for inserting an external part is formed at a front side of the helmet body; vent holes for heat dissipation and ventilating in the helmet body are respectively formed at both sides of the helmet body; and the mounting structure comprises an mounting platform arranged on the helmet body and configured for mounting at least one terminal device;

the mounting platform comprises a mounting bracket and an adapter; wherein the mounting bracket is formed with at least two lateral buckles for being respectively clamped into the vent holes at the sides of the helmet body and a forward buckle for being inserted into the jack at the front side of the helmet body; the mounting bracket is mounted on the helmet body by clamping the two lateral buckles into the respective vent holes and inserting the forward buckle into the jack;

the adapter is detachably mounted on the mounting bracket; and the adapter is formed with a T-shaped buckle for inserting at least one terminal device.

2. The mounting structure of the helmet according to claim 1, wherein, a support plane for supporting the mounted terminal device is respectively formed at an upper end and a lower end of the T-shaped buckle.

3. The mounting structure of the helmet according to claim 1, wherein, the mounting bracket is formed with a mounting surface;

a mounting shaft is respectively formed at both sides of the mounting surface;

shaft sleeves for matching with two mounting shafts are respectively formed at two sides of the adapter;

the adapter is detachably mounted on the mounting bracket by inserting the mounting shafts into the shaft sleeves.

4. The mounting structure of the helmet according to claim 3, wherein, the mounting shaft is formed with a guide ramp for guiding a respective sleeve to be sleeved on a periphery of the mounting shaft.

5. The mounting structure of the helmet according to claim 3, wherein, the mounting bracket is provided with a steering gear for adjusting an angle of the adapter on the mounting surface;

the steering gear is rotatably provided with toggle teeth;

the adapter is formed with a rotating latch for meshing with the toggle teeth; and the rotating latch is configured to cause the toggle teeth to rotate by pressing the toggle teeth.

6. The mounting structure of the helmet according to claim 5, wherein, the shaft sleeve is formed with a rotating latch.

7. The mounting structure of the helmet according to claim 2, wherein, the adapter is further formed with two elastic support sheets for elastically supporting and pressing the terminal device; and the elastic support sheets are formed with a support protrusion for protruding and supporting the terminal device so as to form a heat dissipation gap between the terminal device and the adapter.

8. The mounting structure of the helmet according to claim 7, wherein, the mounting surface is formed with two ribs for abutting against the elastic support sheets to force the elastic support sheets to press the mounted terminal device; and the two ribs are arranged in one-to-one correspondence with the two elastic support sheets.

9. The mounting structure of the helmet according to claim 1, wherein, an adjusting fan for adjusting sizes of the vent holes is respectively slidably connected at two sides in the helmet body;

an adjusting hole is respectively provided at the both sides of the helmet body;

the adjusting fan is formed with an adjusting protrusion; and the adjusting protrusion is configured to pass through the adjusting hole and slide up and down along the adjusting hole.

10. The mounting structure of the helmet according to claim 9, wherein, an arched guide surface for matching with an upper side of the adjusting fan to guide the adjusting fan to slide up and down so as to close or open the vent holes is formed at a lower end of a part where the lateral buckles are clamped into the vent holes.

* * * * *